US008215317B2

(12) United States Patent
Hartman

(10) Patent No.: US 8,215,317 B2
(45) Date of Patent: Jul. 10, 2012

(54) SELF-LIGHTING CIGARETTE

(76) Inventor: Terry Hartman, Tacoma, WA (US)

( * ) Notice: Subject to any disclaimer, the term of this patent is extended or adjusted under 35 U.S.C. 154(b) by 380 days.

(21) Appl. No.: 12/504,356

(22) Filed: Jul. 16, 2009

(65) Prior Publication Data

US 2011/0011415 A1 Jan. 20, 2011

(51) Int. Cl.
*A24D 1/10* (2006.01)

(52) U.S. Cl. ..... 131/351; 131/347

(58) Field of Classification Search ..... None
See application file for complete search history.

(56) References Cited

U.S. PATENT DOCUMENTS 1,327,139 A * 1/1920 Brown ..... 131/351
1,454,902 A * 5/1923 McClain ..... 131/351
1,723,068 A * 8/1929 Parsons ..... 156/519
2,080,536 A * 5/1937 Durden ..... 131/29
3,273,568 A * 9/1966 Di Carlo, Jr. ..... 131/351
3,692,030 A * 9/1972 Whang ..... 131/351
3,994,305 A * 11/1976 Hughes ..... 131/351
4,616,665 A * 10/1986 Cho ..... 131/351

* cited by examiner

*Primary Examiner* — Michael J Felton
(74) *Attorney, Agent, or Firm* — The Law Office of Jerry D. Haynes

(57) ABSTRACT

The present invention relates to a self striking cigarette comprising: cigarette paper, where said cigarette paper includes a phosphorous dipped edge; a tobacco product, where the tobacco product is rolled within the cigarette paper; and a filter, where said filter is attached to the rolled cigarette paper at the non-phosphorous end. In one exemplary embodiment, the cigarette paper is ribbed along the phosphorous edge to provide a reinforcement means. The self striking cigarettes according the present invention may be packaged as a plurality of phosphorous tipped cigarettes stored within a cigarette box, where said cigarette box includes at least one striking surface in the lower corner of the cigarette box. The present invention also contemplates a method of creating a self striking cigarette.

7 Claims, 1 Drawing Sheet

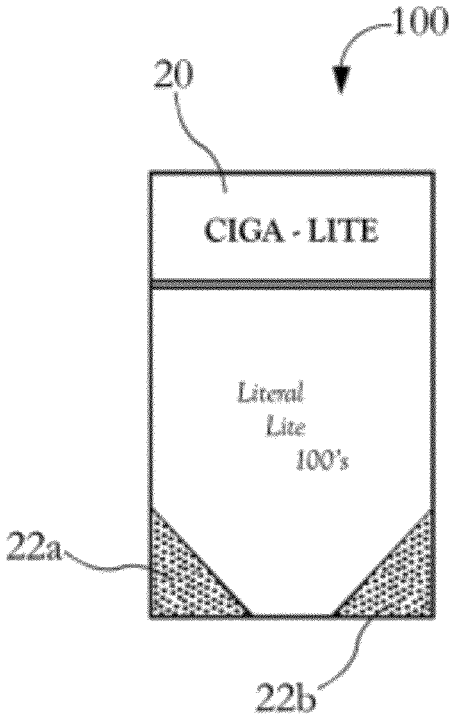
100
20
CIGA - LITE
Literal
Lite
100's
22a
22b
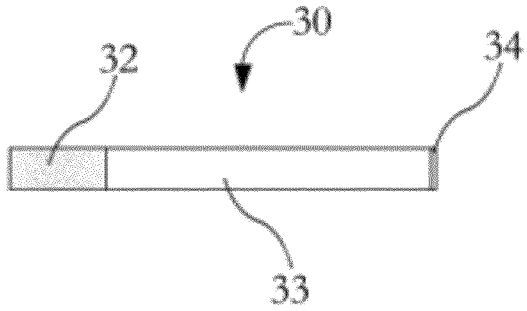
30
32
34
33

SELF-LIGHTING CIGARETTE

BACKGROUND OF THE INVENTION

1. Field of Invention

The present invention relates to a self-lighting cigarette that includes an ignition tip that may be ignited by stroking across a striking pad.

2. Description of Related Art

Cigarettes manufactured by most manufacturers and include a cigarette paper surrounding treated tobacco and may include a filter at one end thereof. At the non-filtered end of the cigarette an individual applies fire in the form of a match or a cigarette lighter in order to ignite the cigarette for smoking purposes. Although the renowned method of enjoying cigarettes includes the use of a lighter or match it would be advantageous to have a cigarette that came equipped with an igniting substance in order to ignite the cigarette therefore alleviating the necessity of a match or a cigarette lighter.

The prior art includes examples of self-igniting or self-lighting cigarettes which include tips that have been developed to include an ignitable composition. U.S. Pat. No. 1,815,162 discloses a cigarette that includes an igniting band wrapped around the outer edge of the cigarette tip. The igniting band disclosed in the '162 patent requires adhesive to attach the igniting band to the outside of the wrapper and thus increases the circumference of the cigarette at the tip thereof therefore requiring larger size packaging.

U.S. Pat. No. 2,080,536 discloses a cigarette that includes a series of igniting plugs along the outside perimeter edge of the tip of the cigarette. These igniting plugs may be stroked against the striking surface in order to ignite the cigarette for smoking purposes.

U.S. Pat. No. 3,273,568 discloses a cigarette that includes a self-igniting paper member that extends from the tip of the cigarette that provides a striking member to ignite the cigarette. The striking member is manufactured of a higher weight of paper and is adhered to the outer surface of the cigarette paper that holds the tobacco of the cigarette.

U.S. Pat. No. 4,616,665 discloses yet another exemplary cigarette with a striking surface where a match is adhesively attached to the tip of the cigarette with a striking portion provided under a lip of the tip of the cigarette. The match and striking portion are therefore self-contained in the tip of the cigarette.

The self-striking cigarettes of the prior art include various complications to the sizing of the cigarette and in some cases additional paper or special cutting of the cigarette paper associated with the cigarette. These complications make the self-lighting cigarettes impractical for mass production. It was therefore be advantageous to develop a self-striking cigarette that overcomes some of the problems associated with the prior art.

SUMMARY OF THE INVENTION

The present invention relates to a self striking cigarette comprising: cigarette paper, where said cigarette paper includes a phosphorous dipped edge; a tobacco product, where the tobacco product is rolled within the cigarette paper; and a filter, where said filter is attached to the rolled cigarette paper at the non-phosphorous end. In one exemplary embodiment, the cigarette paper is ribbed along the phosphorous edge to provide a reinforcement means. The self striking cigarettes according the present invention may be packaged as a plurality of phosphorous tipped cigarettes stored within a cigarette box, where said cigarette box includes at least one striking surface in the lower corner of the cigarette box.

The present invention also contemplates a method of creating a self striking cigarette comprising the steps of: cutting cigarette paper to a predetermined size, where the cigarette paper includes a dipping edge and a filter edge; dipping the dipping edge into a phosphorous solution; allowing the phosphorous to dry; rolling a tobacco product in the cigarette paper; and attaching a filter to the filter edge of the cigarette paper.

BRIEF DESCRIPTION OF DRAWINGS

FIG. 1 depicts a self-lighting cigarette and a cigarette pack design according to the present invention.

DETAILED DESCRIPTION

The present invention provides a unique self-lighting cigarette and a striking surface on the accompanying cigarette box that overcomes the above complications associated with self-lighting cigarettes of the prior art. The present invention includes a cigarette that includes a phosphorous tip that provides an igniting means to ignite the cigarette with the use of a striking surface provided on the box container for the cigarettes.

FIG. 1 depicts a Cigarette Box 100 for the self-lighting cigarette that is contained therein and a Cigarette 30 that is contained within the Cigarette Box 100. The Cigarette Box 100 includes a lifting and re-closable top 20 and two striking pads at the bottom front corners where the Striking Pads 22*a*, 22*b* are depicted thereon. The Cigarette Box 100 contains cigarettes that include a Phosphorous Tip 34 depicted on a Cigarette 30. The Phosphorous Tip 34 is the igniting substance for Cigarette 30. The remaining portions of the cigarette are Cigarette Filter 32 and the rolled tobacco within the Cigarette Paper 33. The Phosphorous Tip 34 provides the igniting means for the Cigarette 30.

Phosphorous is placed at the tip of Cigarette 30 by dipping the cigarette paper in a phosphorous solution and allowing the phosphorous solution to cover the tip of the cigarette. Once the cigarette is dipped in this phosphorous solution according to the present invention, the phosphorous solution is allowed to dry, the cigarette may be rolled and the self-lighting cigarettes are packed in the Cigarette Box 100. Once the Cigarette Box 100 is sealed it is ready for purchase by a consumer. The consumer after purchasing the self striking cigarettes in Cigarettes Box 100, removes a Cigarette 30 and uses either Striking Pad 22*a*, 22*b* in order to ignite the Cigarette 30. Further since the phosphorous solution is dipped on the tip of the cigarette there is no additional paper or adhesive needed in order to create the ignition tip associated with the self-lighting cigarette according to the present invention. Once the Cigarette 30 is ignited the phosphorous solution burns off and does not leave an aftertaste or affect the taste of the cigarette.

The dipping process associated with applying the phosphorous solution to the tip of Cigarette 30 involves dipping cigarette paper into a phosphorous solution prior to the cigarettes being rolled with the tobacco. The cigarette paper is slightly ribbed at the tip thereof to increase the strength of the paper so that the paper does not break during the striking process. The unique ability to add the phosphorous to the tip of the cigarette prior to rolling therefore alleviates some of the problems known with the prior art self-lighting cigarettes. The present invention provides a unique self-lighting cigarette that would be an enjoyment for many cigarette smokers to use and alleviates the necessity of additional lighting materials such as matches or cigarette lighters.

What is claimed is:

1. A self striking cigarette comprising:

a. cigarette paper, where said cigarette paper includes a phosphorous dipped edge;

b. a tobacco product, where the tobacco product is rolled within the phosphorous dipped cigarette paper and c. a filter, where said filter is attached to the rolled cigarette paper at the non-phosphorous end.

2. The self striking cigarette according to claim 1, where said cigarette paper is ribbed along the phosphorous edge to provide a reinforcement means.

3. A self striking cigarette system comprising:

a. a plurality of self striking cigarettes according to claim 1; and b. a cigarette box, where said cigarette box provides a means to store the plurality of phosphorous tipped cigarettes.

4. The self striking cigarette system according to claim 3, where the cigarette box includes at least one striking surface in the lower corner of the cigarette box.

5. A method of creating a self striking cigarette comprising the steps of a through e in the order that follows:

a. cutting cigarette paper to a predetermined size, where the cigarette paper includes a dipping edge and a filter edge;

b. dipping the dipping edge into a phosphorous solution;

c. allowing the phosphorous to dry;

d. rolling a tobacco product in the cigarette paper; and e. attaching a filter to the filter edge of the cigarette paper.

6. The method of creating a self striking cigarette according to claim 5, further comprising the step of ribbing the dipping edge of the cigarette paper.

7. The method of creating a self striking cigarette according to claim 6, further comprising the steps of:

a. creating box to package a plurality of self striking cigarettes;

b. cutting a re-closable opening at the top of the box;

c. attaching a striking pad in at least one lower corner of the box; and d. packaging the plurality of self striking cigarettes in the box.

* * * * *